US005947331A

United States Patent [19]

Goncalves

[11] Patent Number: 5,947,331

[45] Date of Patent: Sep. 7, 1999

[54] DISPENSING CLOSURE WITH RETRACTING END FOR CONTAINERS

[75] Inventor: Agnès Goncalves, Soisy Sous Montmorency, France

[73] Assignee: DEFI International, Soisy-sous-Montmorency, France

[21] Appl. No.: 08/973,542

[22] PCT Filed: Apr. 15, 1997

[86] PCT No.: PCT/FR97/00664

§ 371 Date: Dec. 18, 1997

§ 102(e) Date: Dec. 18, 1997

[87] PCT Pub. No.: WO97/39961

PCT Pub. Date: Oct. 30, 1997

[30] Foreign Application Priority Data

Apr. 19, 1996 [FR] France ..... 96 04906

[51] Int. Cl.[6] ..... B67D 5/32

[52] U.S. Cl. ..... 222/39; 222/521; 222/549

[58] Field of Search ..... 222/39, 509, 519, 222/520, 521, 522, 523, 524, 525, 531, 537, 549, 555

[56] References Cited

U.S. PATENT DOCUMENTS

| | | | |
|---|---|---|---|
| 5,004,127 | 4/1991 | Morel | 222/521 |
| 5,377,873 | 1/1995 | Minnette | 222/39 |
| 5,397,195 | 3/1995 | Goncalves | 401/277 |
| 5,421,487 | 6/1995 | Moretti | 222/521 |
| 5,431,305 | 7/1995 | Kaminski | 222/521 |
| 5,458,274 | 10/1995 | Maietta | 222/39 |

FOREIGN PATENT DOCUMENTS

| | | |
|---|---|---|
| 0630597 | 12/1994 | European Pat. Off. . |
| 2327159 | 5/1977 | France . |
| 2631318 | 11/1989 | France . |

*Primary Examiner*—Joseph A. Kaufman
*Attorney, Agent, or Firm*—Greenblum & Bernstein, P.L.C.

[57] ABSTRACT

A dispensing closure for containers. The closure includes a cap which is fixedly mounted in an axial direction with respect to the container, but at least an actuating part thereof is rotatably mounted, and it is provided with at least one passage opening in which an end piece provided with an aperture for dispensing the product is movably mounted between at least a retracted closing position and a projecting open position, while a closure element is equipped with a stopper for closing or opening by the combined structure provided on it, in the cap and on the closure element. The end piece of the closure is slidingly mounted but fixed in rotation in the closure element, while the combined structure of the end piece and cap have provided, respectively, on the external wall of the end piece and in an internal collar of the rotating actuating part of the cap, in the form of a hollow shaft secured to it so that rotation in one direction or the other causes the end piece to screw or unscrew the collar and, therefore, to slide without turning the closure element.

22 Claims, 2 Drawing Sheets

FIG.1
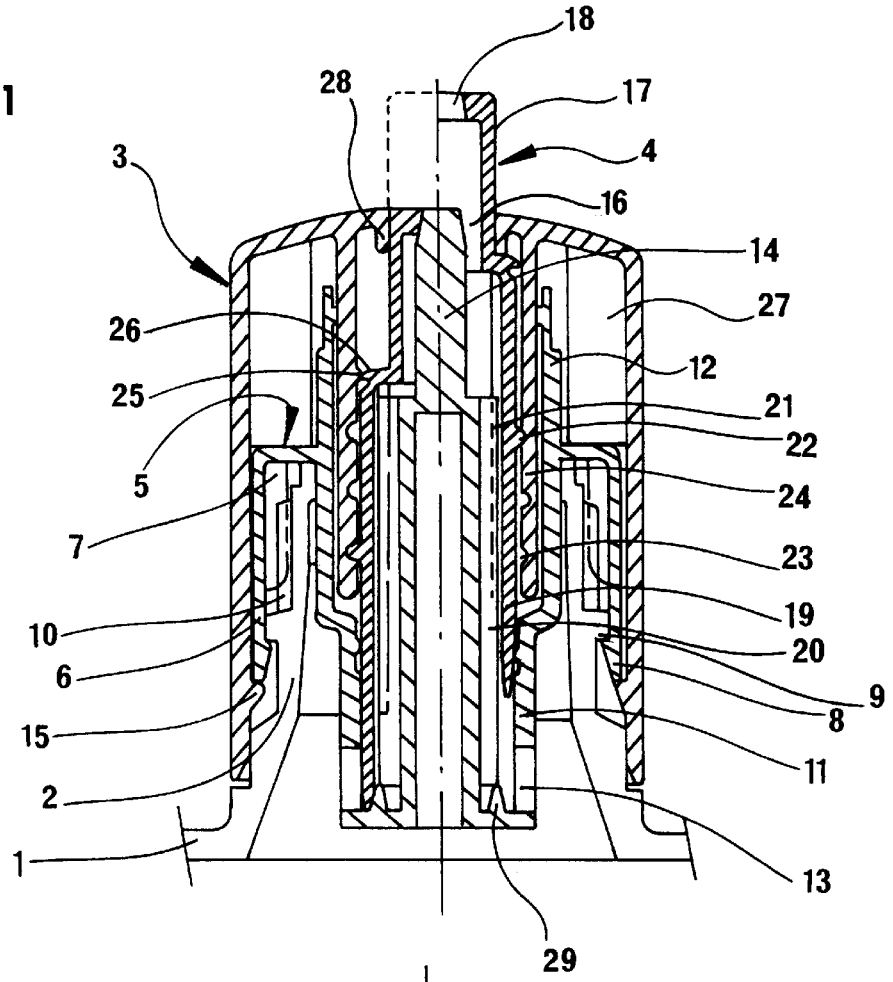
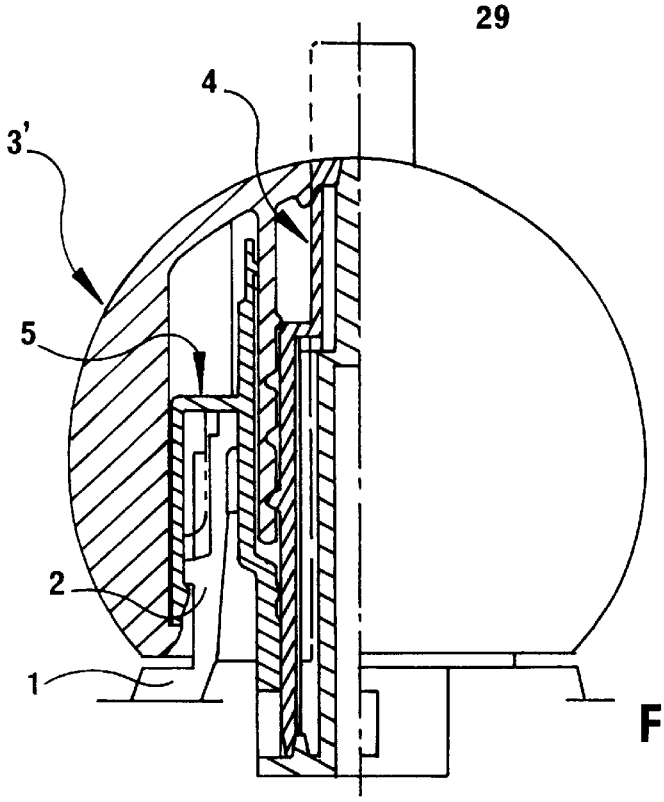
FIG.2

DISPENSING CLOSURE WITH RETRACTING END FOR CONTAINERS

BACKGROUND OF THE INVENTION

1. Field of the Invention

The invention is related to a dispensing closure with a retracting end, for containers.

2. Description of Background and Relevant Information

Traditional stopper systems having so-called "pour spouts" are known, especially for cleaning products, cosmetics or certain beverages.

Generally, the pour spout is fixed on the neck or the ring of the container, while a cap covers said spout by being screwed on the neck.

It is understood that in order to use a container equipped in this manner, it is of course necessary to have previously removed the cap completely.

In addition, dispensing closures, also known as "service closures" are known that advantageously replace the simple stoppers or caps requiring unscrewing, said closures remaining contiguous to the container, whereas the opening and closing is done via a special maneuver of the closure.

In order to retain the advantages of both the above-cited pour spout as well as the service closure, and also to ensure that certain wiping operations for the spout are possible, a dispensing closure has already been envisioned, as described in the French patent No. 2 631 318. As described therein, the closure is of the type comprising a cap that is fixedly mounted in axial translation with respect to the container, but at least one of whose actuating parts is rotationally mounted, and which is equipped with at least one passage opening in which an end piece equipped with a product dispensing aperture is movably mounted between at least one retracted closing position and one projecting opening position. A closure element designed to be secured on the neck of the container is equipped with a stopper intended to block or free the aperture of the end piece when the latter is in the retracted closing or projecting opening positions respectively, the movement of the end piece being ensured by the combined means provided thereupon, in the cap and on the closure element.

In this known device, the cap and the end piece are affixed during rotation and free during translation, while the end piece is screwed and unscrewed on the closure element in such a way that during its helical movement, the end piece rotates at the same time as the cap.

It is also understood that in such a structure, the entire mechanism is positioned externally with respect to the neck of the container, and this proportionately reduces, in order to have an acceptable external volume, the diameter of the opening of the neck due to the addition of thicknesses of the elements and therefore limits the filling rate of the container.

In addition, the height by which the end piece exceeds outside the cap is limited by the height of the closure element on which the end piece is screwed, and this makes this device ill-adapted for certain types of use.

The latter disadvantage is the reason for which the instant invention proposes a closure of the above-cited type, but it is noteworthy in that the end piece is slidably mounted, though fixed during rotation in the closure element, while the combined means of the end piece and the cap are screwing and unscrewing means that are respectively arranged on the external wall of the end piece and in an internal collar of the rotational actuating part of the cap, such that the rotation thereof in either one direction or the other, causes the screwing or the unscrewing of the end piece in the collar and thus its sliding, without turning, in the closure element, the end piece being therefore able to go from its retracted closing position to its projecting opening position or vice-versa.

In this way, since the mechanism is housed within the neck of the container, the neck necessarily has a wide opening, and this favors the filling of the container.

In addition, the end piece can exceed substantially towards the outside because the mechanism that enters the neck of the container, or even in the container itself, has a height that can be greater than the external height of the closure, and is not, in any case, limited by the external height.

Preferably, the combined screwing and unscrewing means of the cap and the end piece are such that a rotation of the rotational actuating part of the cap respectively in the trigonometric or retrogressive direction with respect thereto, causes a screwing or an unscrewing, respectively, of the end piece in the collar and thus an opening or a closing movement, respectively.

Advantageously, the combined means of the cap and the end piece comprise a threading or projecting means arranged in the collar and combined means arranged on the external wall of the end piece in the form of projecting means or respectively a threading.

According to one embodiment, the cap is made all in one piece, and is rotationally mounted on the neck of the container, the actuating collar being obtained by an inner hollow shaft of the cap, arranged coaxially with respect to the opening of the cap.

In this case, due to reasons of manufacturing and cost related problems, the inner hollow shaft of the cap is split diametrically so that it can be extraction molded.

Indeed, it is well known that an extraction mold, as compared to an unscrewing mold, is much less costly and in addition, it allows for greater manufacturing speeds.

Especially, but not exclusively, in this case, the closure element has a central skirt adapted to surround the hollow shaft of the cap on which it can rotate, such that the hollow shaft of the cap, though split, remains maintained perfectly.

Other special characteristics can naturally be provided, and this is how, for example, according to one embodiment, the external wall of the end piece and the internal wall of the hollow shaft of the cap are equipped with elastic means that cooperate with one another by gripping in the retracted position so as to cause an audible signal and/or a locking during opening and closing, by the forced passage of the means on one another, during the translation of the end piece.

However, it is entirely possible to envision an embodiment wherein the cap has a fixed outer covering, the rotational part being constituted of a collar controlled by a lever that projects outwardly through a window arranged in the fixed covering.

The combined sliding means of the end piece and the closure element are, for example, constituted of grooves or ribs arranged on the end piece and ribs or grooves respectively arranged in the closure element, and according to one embodiment, the end piece has a cylindrical tubular part that covers the stopper of the closure element, said stopper being present in the form of a shaft, whereas the combined sliding means of the end piece and of the closure element comprise vanes arranged at the lower part of said shaft forming the stopper and combined flutings arranged on the internal wall of said tubular part of the end piece.

In order to especially ensure a double seal, the invention proposes an embodiment that is noteworthy in that the closure element comprises a well that extends into the neck of the container and in which the end piece slides, the well being closed at its base, but comprising lateral windows for the passage of the product, whereas the shape and size of the end piece are such that in the retracted closing position, the external wall of the base of the end piece blocks the windows in such a way that the end piece and the closure element ensure a double blocking of both the cap opening as well as the passage windows of the closure element.

BRIEF DESCRIPTION OF THE DRAWINGS

The invention will be better understood and other preferred characteristics thereof will become more apparent upon reading the description that follows with reference to the annexed drawings wherein:

FIG. 1 represents an axial section of a closure as per the invention, with half the section representing the opening position and half the section representing the closing position, FIG. 2 shows a simple variation of FIG. 1 as regards the shape of the cap in an axial half-section.

DETAILED DESCRIPTION OF THE INVENTION

Figure 3:
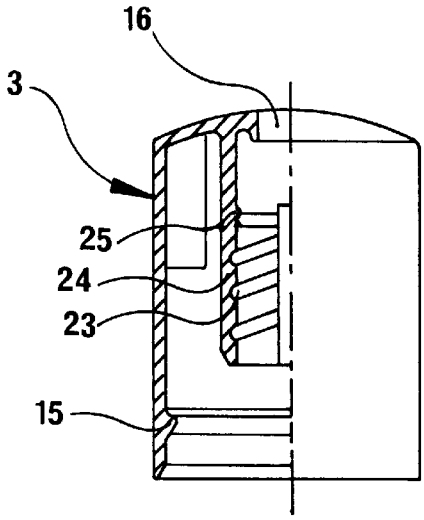
FIGS. 3, 4 and 5 represent, half in an elevation and half in an axial section, the three component elements of the closure of FIG. 1, or in other words, respectively: the cap, the end piece and the closure element.

In the drawings, one can see a dispensing closure as per the invention, adapted to equip a container 1 (flask, tube or similar) equipped with a ring or a neck 2 (FIGS. 1 and 2).

Figure 4:
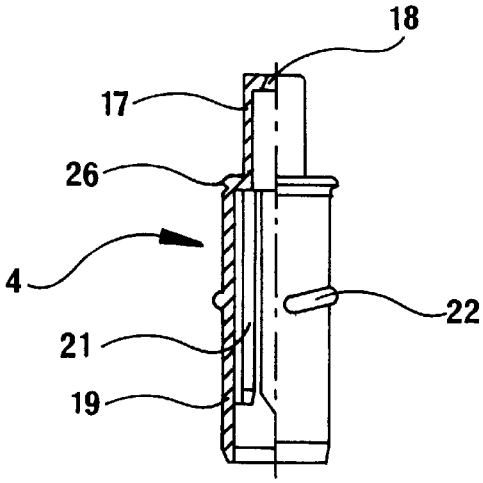
Figure 5:
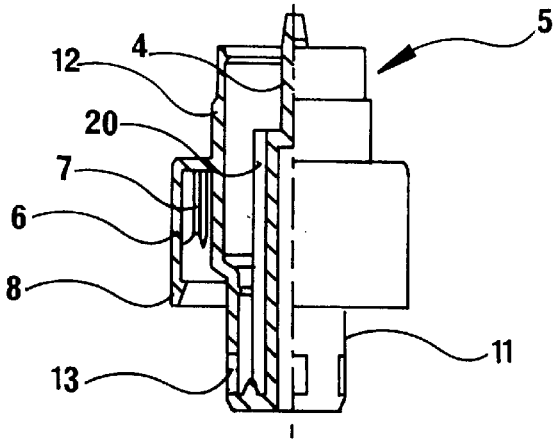

The dispensing closure as per the invention here comprises three elements represented separately in FIGS. 3, 4 and 5, respectively a cap 3 (FIG. 3), an end piece 4 (FIG. 4) and a closure element 5 (FIG. 5).

The three elements are assembled together and maintained on the container 1, as represented in FIGS. 1 and 2, FIG. 2 being a simple variation in the shape of the cap, which is cylindrical in FIG. 1 and bears the reference numeral 3, whereas it is spherical in FIG. 2 and bears the reference numeral 3'.

For reasons of clarity and in order to avoid unnecessary repetitions, all the reference numerals of FIG. 1 have not been repeated in their entirety in FIG. 2, since all the elements are identical, with the sole exception of the shape of the cap.

The closure element 5, represented separately in FIG. 5, has an outer skirt 6 equipped with outer serrations 7 and a structural portion in the form of an end rib 8 so as to become immovably secured on the neck 2 of container 1, as can be seen from FIGS. 1 and 2, by means of a combined rib 9 and serrations 10 arranged on the neck 2, of the container the edge of whose opening is straddled by the outer skirt 6 of the closure element 5.

The closure element 5 has, in addition, a central well 11 that extends in a sealed manner into the opening of the neck 2 and into the container 1 and which is extended on the opposite side by a cylindrical skirt 12.

The well 11 is closed at its base but laterally, it has passage windows 13 for the product contained in the container 1, whereas the closure element has, in its central portion, a shaft 14 intended to form a stopper, as will be explained hereinafter.

The cap 3 is mounted on the closure element 5 in a fixed manner in axial translation, but free in rotation, for example, in this case, by means of a structural portion in the form of a rib 15 that is forcibly housed under the end section of the skirt 6 of the closure element.

The cap 3 is equipped with an opening 16 on the top, intended to permit the passage of the cylindrical end 17 of the end piece 4, the end being equipped with a dispensing aperture 18 for the product.

The end piece 4 is tubular and has a cylindrical base 19 having a bigger diameter than its previously cited cylindrical end part 17, and which is slidably mounted in the well 11 of the closure element 5.

In order to secure the end piece 4 and the closure element 5 during rotation, while also ensuring guidance during translation, the closure element has (FIGS. 1 and 5) ribs or vanes 20 arranged on the lower part of its shaft forming the stopper 14 (for example, two diametrical vanes) and intended to cooperate with the combined ribs or flutings 21 provided inside the cylindrical base 19 of said end piece (FIGS. 1 and 4).

In order to enable the elevation of the end piece 4 or its retraction, the cylindrical part 19 thereof comprises raised elements such as tappets or, as is the case here, threaded portions 22 (FIGS. 1 and 4) intended to cooperate with a threading 23 arranged on the internal wall of a hollow shaft 24 arranged in the cap 3, coaxially with respect to its opening 16 (FIGS. 1 and 3).

The sizes and shapes of the elements are such that in the closing position (left hand side of FIGS. 1 and 2), the end 17 of the end piece 4 is housed in the opening 16 of the cap 3 and comes to the level of the top of the latter, whereas the narrowed end of the shaft 14 blocks the aperture 18 of the end piece 4, and whereas the base of the cylindrical part 19 of the end piece blocks the windows 13 of the well 11 of the closure element 5.

In addition, in this position, two elastic projections 25, 26 arranged in the hollow shaft 24 and respectively on the end piece 4 at the level of the shoulder formed by the transition between the parts 17 and 19 thereof (FIGS. 1, 3 and 4) come into engagement by gripping.

Inversely, in the opening position (right hand side of FIG. 1), the end 17 of the end piece 4 projects from the cap 3 in such a way that the aperture 18 and the windows 13 are unblocked.

In addition, one notes that the cap 3 has support elements 27 that come into contact with the closure element 5 and that, especially in order to improve the seal, the end of the shaft 14 is truncated, the opening 16 of the cap 3 being bordered by a small inner skirt 28, at the same time as the base of the well 11 is equipped with a crown 29 that is housed, during closing, in the part 19 of the end piece 4.

In order to assemble the elements of the dispensing closure together, one only needs to first screw the end piece 4 in the hollow shaft 24 of cap 3, and then secure the closure element 5 and the cap 3 by clipping them together.

Thereafter, the dispensing closure is arranged on the container 1 after the latter has been filled, by securing the closure element on the neck of the container, as has been specified hereinabove.

The functioning is clear.

In the closing position represented, as has been mentioned earlier, on the left hand side of FIGS. 1 and 2, it is to be understood that the aperture 18 is blocked by the shaft 14 and that the windows 13 are blocked by the part 19 of the end piece 4, thus ensuring a double seal.

In order to open the dispensing closure, one has only to rotate the cap 3, which causes the elevation of the end piece 4 by the screwing thereof in the hollow shaft 24.

However, it is to be understood that the end piece 4 slides without turning in the closure element 5 by the sliding of the vanes 20 of the closure element relative to the flutings 21 of the end piece, until it comes to the opening position represented on the right hand side of FIG. 1, which position is limited by the transition shoulder between the parts 17 and 19 of the end piece 4 with the skirt 28 of the cap.

In this position, the product in the container 1 can thus pass through the windows 13 of the closure element in order to reach the aperture 18 while passing around the shaft 14.

By rotating in the other direction, it is to be understood that one obtains an inverse movement and a passage from the opening position towards the closing position.

For ergonomical reasons, a pitch is selected for the screw structure, such as a rotation in the trigonometric or retrogressive direction of cap 3, with respect thereto, causing the screwing or unscrewing of the end piece and thus the opening or closing of the dispensing closure.

Finally, it is to be also understood that at the start of the rotation during opening, or at the end of the rotation during closing, the elastic means 25, 26, ensure an audible signal and/or a locking during opening or closing by a forced passage, such means being artful because they could have been arranged more traditionally on the rotational elements.

Numerous variations can obviously be envisioned without leaving the scope of the invention.

This is how, especially, the screwing means 22, 23 of the end piece 4 and the hollow shaft 24 can obviously be reversed (female threading on the end piece and tappets or male threading in the hollow shaft).

Similarly, for the guide means during the translation of the end piece 4 and the closure element 5, the vanes 20 and the flutings 21 can naturally be provided inversely, respectively in the end piece and in the closure element.

In addition, as has already been mentioned, the cap 3 could be made up of two parts, or in other words, a fixed covering and a rotating collar in engagement with the end piece and actuated from the outside by a lever passing through a window of the fixed covering.

I claim:

1. A dispensing closure for a container, said dispensing closure comprising:

a closure element having a structural portion for being secured to the container and having a portion adapted to extend into the container;

a cap having a structural portion in engagement with the closure element for mounting the cap upon the closure element against translational movement with respect to the closure element, the cap having at least an actuating part rotationally movable with respect to the container, the actuating part including an internal collar, the cap having at least one passage opening communicating with the internal collar;

an end piece having a dispensing aperture, the end piece extending through the passage opening of the cap, said end piece being slidably mounted in the internal collar of the cap for translational movement with respect to the closure element, but fixed against rotation with respect to the closure element, said translational movement of the end piece including movement with respect to the cap between at least one retracted closed position and at least one projecting open position, said end piece and said closure element having respective portions of a sliding structure for effecting said translational movement of the end piece, said respective portions comprising ribs on one of said end piece and said closure element and grooves on the other of said end piece and said closure element, said ribs and grooves extending in a direction of said translational movement and being in sliding engagement;

said closure element having a stopper for blocking the dispensing aperture in said retracted closed position of the end piece and for unblocking the dispensing aperture in said projecting open position of the end piece;

said end piece having an external wall, said internal collar of the actuating part of the cap having an internal wall, said external wall and said internal wall constituting a combined screw structure, whereby rotation of said cap in a first rotational direction effects said translational movement of said end piece by way of said screw structure toward said projecting open position of said end piece and rotation of said cap in a second rotational direction effects said translational movement of said end piece by way of said screw structure toward said retracted closed position of said end piece.

2. A dispensing closure according to claim 1, wherein:

said screw structure comprises a threading formed on the end piece and a complementary threading formed on the collar of the cap, said threadings of the end piece and the collar being in engagement.

3. A dispensing closure according to claim 1, wherein:

said screw structure comprises a projecting means formed on the end piece and a complementary projecting means formed on the collar of the cap, said threadings of the end piece and the collar being in engagement.

4. A dispensing closure according to claim 1, wherein:

said cap is a unitary piece adapted to be rotationally mounted on the neck of the container, the cap having an outermost surface, the collar of the actuating part of the cap being constituted by an inner hollow shaft positioned within said outermost surface of the cap and positioned coaxially with respect to the passage opening of the cap.

5. A dispensing closure according to claim 4, wherein:

said inner hollow shaft of the collar is split diametrically for extraction molding.

6. A dispensing closure according to claim 4, wherein:

said closure element includes a central skirt for surrounding the hollow shaft of the cap, said central skirt being mounted for rotation around the hollow shaft of the cap.

7. A dispensing closure according to claim 4, wherein:

said external wall of the end piece and said internal wall of the collar of the cap include respective elastic elements for a gripping engagement in the retracted closed position and with an audible signal upon engagement and disengagement upon forced passage of said elastic elements during said translational movement of the end piece to and moved from, respectively, the retracted closed position.

8. A dispensing closure according to claim 4, wherein:

said external wall of the end piece and said internal wall of the collar of the cap include respective elastic elements for a locking engagement in the retracted closed position upon forced passage of said elastic elements during said translational movement of the end piece to and moved from, respectively, the retracted closed position.

9. A dispensing closure according to claim 1, wherein:

said end piece includes a tubular cylindrical part covering the stopper of the closure element, said stopper constituting a shaft;

said sliding structure constituted by respective portions of the end piece and the closure element comprise:

vanes arranged in a lower part of the shaft of the stopper; and flutings arranged on an internal wall of the tubular cylindrical part of the end piece.

10. A dispensing closure according to claim 1, wherein:

said closure element comprises a well having a length adapted to extend into a neck of the container, the translational movement of the end piece being adapted to position the end piece into the well of the closure element, the well having a closed base and lateral windows for passage of a product to be contained in the container;

said end piece having a lower external surface and being configured and arranged so that in the retracted closed position, the end piece and the closure element ensure a double blockage by blocking both the windows of the well of the closure element and the passage opening of the cap, whereby the lower external surface of the end piece blocks the windows of the well of the closure element and the stopper of the closure element blocks the dispensing aperture of the end piece.

11. A dispensing closure according to claim 1, wherein:

said structural portion of the closure element comprises an end rib and said structural portion of the cap comprises a rib for engaging said end rib of the closure element.

12. A container having a dispensing closure, said container comprising:

a container having an opening formed by a neck;

a dispensing closure affixed to said container, said closure comprising:

a closure element having a structural portion secured to the container and a portion extending into the opening of the container;

a cap having a structural portion in engagement with the closure element for mounting the cap upon the closure element against translational movement with respect to the closure element, the cap having at least an actuating part rotationally movable with respect to the container, the actuating part including an internal collar, the cap having at least one passage opening communicating with the internal collar;

an end piece having a dispensing aperture, the end piece extending through the passage opening of the cap, said end piece being slidably mounted in the internal collar of the cap for translational movement with respect to the closure element, but fixed against rotation with respect to the closure element, said translational movement of the end piece including movement with respect to the cap between at least one retracted closed position and at least one projecting open position, said end piece and said closure element having a respective portions of a sliding structure for effecting said translational movement of the end piece, said respective portions comprising ribs on one of said end piece and said closure element and grooves on the other of said end piece and said closure element, said ribs and grooves extending in a direction of said translational movement and being in sliding engagement;

said closure element having a stopper for blocking the dispensing aperture in said retracted closed position of the end piece and for unblocking the dispensing aperture in said projecting open position of the end piece;

said end piece having an external wall, said internal collar of the actuating part of the cap having an internal wall, said external wall and said internal wall constituting a combined screw structure, whereby rotation of said cap in a first rotational direction effects said translational movement of said end piece by way of said screw structure toward said projecting open position of said end piece and rotation of said cap in a second rotational direction effects said translational movement of said end piece by way of said screw structure toward said retracted closed position of said end piece.

13. A container according to claim 12, wherein:

said screw structure comprises a threading formed on the end piece and a complementary threading formed on the collar of the cap, said threadings of the end piece and the collar being in engagement.

14. A container according to claim 12, wherein:

said screw structure comprises a projecting means formed on the end piece and a complementary projecting means formed on the collar of the cap, said threadings of the end piece and the collar being in engagement.

15. A container according to claim 12, wherein:

said cap is a unitary piece rotationally mounted on the neck of the container, the cap having an outermost surface, the collar of the actuating part of the cap being constituted by an inner hollow shaft positioned within said outermost surface of the cap and positioned coaxially with respect to the passage opening of the cap.

16. A container according to claim 15, wherein:

said inner hollow shaft of the collar is split diametrically for extraction molding.

17. A container according to claim 15, wherein:

said closure element includes a central skirt for surrounding the hollow shaft of the cap, said central skirt being mounted for rotation around the hollow shaft of the cap.

18. A container according to claim 15, wherein:

said external wall of the end piece and said internal wall of the collar of the cap include respective elastic elements for a gripping engagement in the retracted closed position and with an audible signal upon engagement and disengagement upon forced passage of said elastic elements during said translational movement of the end piece to and moved from, respectively, the retracted closed position.

19. A container according to claim 15, wherein:

said external wall of the end piece and said internal wall of the collar of the cap include respective elastic elements for a locking engagement in the retracted closed position upon forced passage of said elastic elements during said translational movement of the end piece to and moved from, respectively, the retracted closed position.

20. A container according to claim 12, wherein:

said end piece includes a tubular cylindrical part covering the stopper of the closure element, said stopper constituting a shaft;

said sliding structure constituted by respective portions of the end piece and the closure element comprise:

vanes arranged in a lower part of the shaft of the stopper; and flutings arranged on an internal wall of the tubular cylindrical part of the end piece.

21. A container according to claim 12, wherein:

said closure element comprises a well extending into a neck of the container, the translational movement of the end piece being adapted to position the end piece into the well of the closure element, the well having a closed base and lateral windows for passage of a product to be contained in the container;

said end piece having a lower external surface and being configured and arranged so that in the retracted closed position, the end piece and the closure element ensure a double blockage by blocking both the windows of the well of the closure element and the passage opening of the cap, whereby the lower external surface of the end piece blocks the windows of the well of the closure element and the stopper of the closure element blocks the dispensing aperture of the end piece.

22. A container according to claim 12, wherein:

said structural portion of the closure element comprises an end rib and said structural portion of the cap comprises a rib for engaging said end rib of the closure element.

* * * * *